US009682569B2

(12) United States Patent
Munakata

(10) Patent No.: US 9,682,569 B2
(45) Date of Patent: Jun. 20, 2017

(54) LIQUID DISCHARGING APPARATUS

(71) Applicant: SEIKO EPSON CORPORATION, Tokyo (JP)

(72) Inventor: Manabu Munakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/251,250

(22) Filed: Aug. 30, 2016

(65) Prior Publication Data

US 2017/0057240 A1 Mar. 2, 2017

(30) Foreign Application Priority Data

Aug. 31, 2015 (JP) ..... 2015-169921
Aug. 26, 2016 (JP) ..... 2016-165384

(51) Int. Cl.

| | |
|---|---|
| ***B41J 2/04*** | (2006.01) |
| ***B41J 2/07*** | (2006.01) |
| ***B41J 2/175*** | (2006.01) |
| ***B41J 2/045*** | (2006.01) |

(52) U.S. Cl.
CPC ..... *B41J 2/17566* (2013.01); *B41J 2/04501* (2013.01); *B41J 2/07* (2013.01)

(58) Field of Classification Search
CPC ..... B41J 2/01; B41J 2/0458; B41J 2/07; B41J 2/04501; B41J 2/04508; B41J 2/04515; B41J 2/04516; B41J 2/0454; B41J 2/0453
See application file for complete search history.

(56) References Cited

U.S. PATENT DOCUMENTS

| | | | | |
|---|---|---|---|---|
| 5,485,179 | A * | 1/1996 | Otsuka | B41J 2/04528 347/14 |
| 6,086,160 | A * | 7/2000 | Bitelli | B28D 1/181 299/102 |
| 6,406,113 | B1 * | 6/2002 | Kato | B41J 2/04553 347/14 |
| 6,729,709 | B2 * | 5/2004 | Konno | B41J 2/04536 347/14 |
| 2017/0043587 | A1 * | 2/2017 | Munakata | B41J 2/0451 |

FOREIGN PATENT DOCUMENTS

JP 2011-011354 A 1/2011

* cited by examiner

*Primary Examiner* — Huan Tran
(74) *Attorney, Agent, or Firm* — Workman Nydegger

(57) ABSTRACT

A liquid discharging apparatus includes a liquid discharging portion which discharges ink supplied from a liquid container, a limit value setting portion which sets a limit value L to be changed with time, and a discharging control portion which controls the liquid discharging portion to discharge the ink with a duty within a range of the limit value L set by the limit value setting portion.

6 Claims, 7 Drawing Sheets

| ELAPSED TIME T | LIMIT VALUE L |
|---|---|
| T1 | L1 |
| T2 | L2 |
| T3 | L3 |
| ⋮ | ⋮ |

C

LIQUID DISCHARGING APPARATUS

TECHNICAL FIELD

The entire disclosure of Japanese Patent Application No. 2015-169921, filed Aug. 31, 2015, and Japanese Patent Application No. 2016-165384, filed Aug. 26, 2016, are expressly incorporated by reference herein.

The present invention relates to a technique of discharging liquid such as ink.

BACKGROUND ART

In the related art, various techniques of controlling an operation of a liquid discharging apparatus which discharges liquid from a plurality of nozzles are proposed. For example, PTL 1 discloses a configuration that a printing duty is decreased in a case of receiving a discharging abnormal signal indicating occurrence of a state (hereinafter, referred to as "non-discharging") in which ink is not discharged from a nozzle.

CITATION LIST

Patent Literature

[PTL 1] Japanese Unexamined Patent Application Publication No. 2011-11354

SUMMARY OF INVENTION

Technical Problem

However, in a technique of PTL 1, an abnormal state of non-discharging of ink actually occurs, and a printing duty is controlled afterward. Therefore, there is a problem in that a medium such as printing paper or ink is wasted in a period from the occurrence of the abnormality to controlling of the printing duty. In consideration of the problems described above, the object of the present invention is that a duty of discharging of liquid is controlled while waste of a medium or liquid is suppressed.

Solution to Problem

In order to solve the problems described above, a liquid discharging apparatus according to a preferred aspect of the present invention includes a liquid discharging portion that discharges liquid supplied from a liquid container, a limit value setting portion that sets a limit value to be changed with time, and a discharging control portion that controls the liquid discharging portion to discharge liquid with a duty within a range of the limit value set by the limit value setting portion. In a configuration described above, since the limit value of the duty of discharging liquid by the liquid discharging portion is changed with time, a discharging failure such as non-discharging caused by a change of the viscosity (for example, increase in viscosity) of the liquid with time can be suppressed, while waste of a medium or liquid is suppressed compared to a configuration in which a duty is controlled after occurrence of the discharging failure.

The liquid discharging apparatus according to the preferred example of the present invention may further include an increase detecting portion that detects an increase of the liquid inside the liquid container, in which the limit value setting portion may initialize the limit value in a case where the increase detecting portion detects the increase of the liquid. In a case where the liquid is increased, the viscosity of the liquid supplied from the liquid container to the liquid discharging portion may be changed (typically, decreased). Therefore, according to a configuration in which the limit value is initialized in a case where the increase detecting portion detects an increase of the liquid, highly efficient discharging of the liquid corresponding to the viscosity after adding liquid is realized.

The liquid discharging apparatus according to the preferred example of a configuration, in which liquid container is capable of being replenished with the liquid, may further include a replenishing amount specifying portion that specifies a replenishing amount of the liquid to the liquid container, in which the limit value setting portion may set the limit value in accordance with the replenishing amount specified by the replenishing amount specifying portion. In the aspect described above, since the replenishing amount of liquid is taken into consideration when setting the limit value to be changed with time, there is an advantage that an appropriate limit value may be set in accordance with the viscosity after change caused by replenishing of the liquid under the circumstance that the viscosity of the liquid being supplied from the liquid container to the liquid discharging portion depends on the replenishing amount of the liquid.

The liquid discharging apparatus according to the preferred example of the present invention may further include a discharging amount specifying portion that specifies an amount of the liquid discharged by the liquid discharging portion, in which the limit value setting portion may set the limit value in accordance with the discharging amount specified by the discharging amount specifying portion. In the aspect described above, since the discharging amount of the liquid is also taken into consideration when setting the limit value to be changed with time, there is an advantage that an appropriate limit value in accordance with the viscosity of the liquid may be set under the circumstance that the viscosity of the liquid being supplied from the liquid container to the liquid discharging portion depends on the discharging amount of the liquid.

According to the preferred example of the present invention, the limit value setting portion may set the limit value in accordance with a non-operation time from the previous turn-off of the power of the liquid discharging apparatus until the current turn-on of the power of the apparatus. In the aspect described above, since the non-operation time of the liquid discharging portion is also taken into consideration when setting the limit value to be changed with time, there is an advantage that an appropriate limit value in accordance with the viscosity of the liquid may be set under the circumstance that the viscosity of the liquid being supplied from the liquid container to the liquid discharging portion depends on the non-operation time.

According to the preferred example of the present invention, an environment sensor that measures at least one of temperature and humidity may be further included, in which the limit value setting portion may set the limit value in accordance with at least one of an environment temperature and an environment humidity according to a result measured by the environment sensor. In the aspect described above, since at least one of the environment temperature and the environment humidity is taken into consideration when setting the limit value to be changed with time, there is an advantage that an appropriate limit value in accordance with the viscosity of the liquid may be set under the circumstance that the viscosity of the liquid being supplied from the liquid container to the liquid discharging portion depends on the environment temperature or the environment humidity.

According to the preferred example of the present invention, the liquid discharging portion may discharge liquid supplied from a plurality of liquid containers which store various liquids different from each other, the limit value setting portion may set the limit value for each liquid container, and the discharging control portion may control the liquid discharging portion to discharge the liquid in the liquid container with a duty within a range of the limit value set relating to each liquid container. In the aspect described above, setting of the limit value by the limit value setting portion and controlling of the duty by the discharging control portion are carried out for each liquid container (for each type of liquid). Therefore, in a circumstance in which a degree of thickening of the liquid in each liquid container (in each type of liquid) may be different, appropriate controlling of an duty in accordance with a degree of thickening of the liquid in each liquid container is realized.

DESCRIPTION OF EMBODIMENTS

First Embodiment

Figure 1:
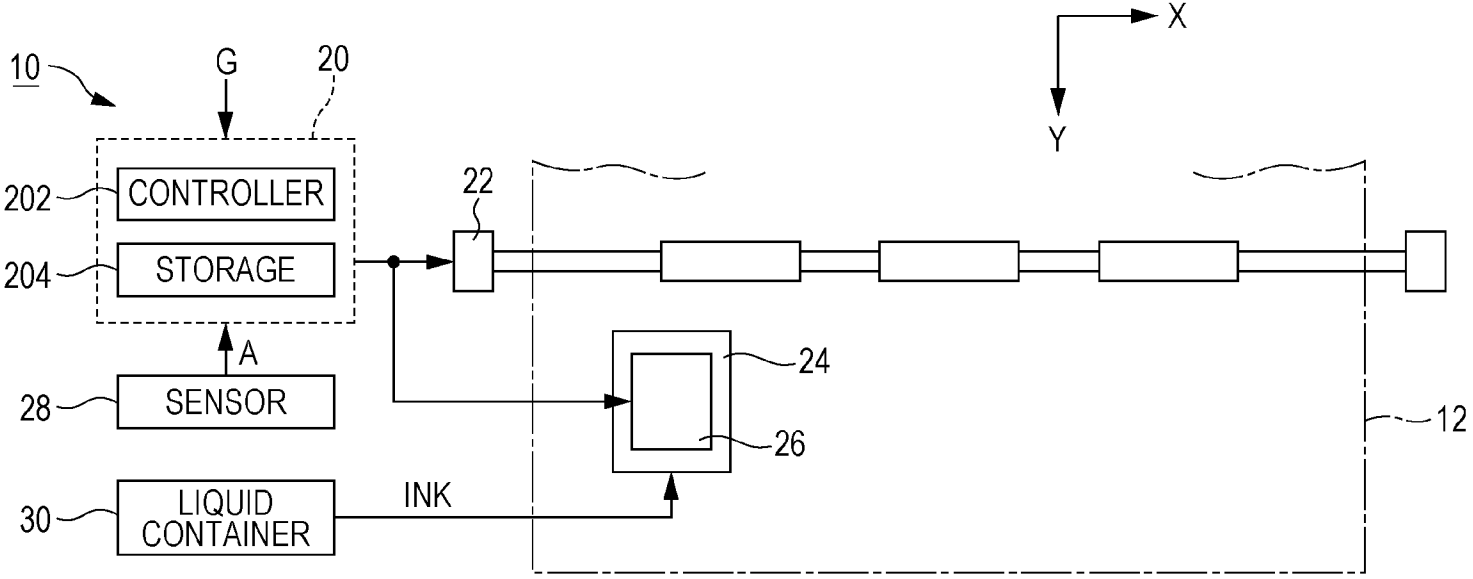
FIG. 1 is a configuration diagram of a liquid discharging apparatus according to a first embodiment.

FIG. 1 is a partial configuration diagram of a liquid discharging apparatus 10 according to a first embodiment of the present invention. The liquid discharging apparatus 10 of the first embodiment is an ink jet printing apparatus which discharges ink, which is an example of liquid, to a medium 12 such as printing paper. As exemplified in FIG. 1, the liquid discharging apparatus 10 includes a control unit 20, a transportation mechanism 22, a carriage 24, a liquid discharging portion 26, a sensor 28, and a liquid container 30. Actually, various types of ink having different colors are stored in the liquid container 30, but for the sake of convenience, one type of ink is focused on in the first embodiment. The liquid discharging apparatus 10 of the first embodiment is a printing apparatus of a continuous ink supply system (CISS) which is capable of replenishing ink later to the liquid container 30. However, a cartridge which is detachable from the liquid discharging apparatus 10 can be used as the liquid container 30.

The control unit 20 is configured with, for example, a controller 202 such as a central processing unit (CPU) or a field programmable gate array (FPGA) and a storage 204 such as a semiconductor memory, and controls collectively each component of the liquid discharging apparatus 10 when the controller 202 executes a control program stored in the storage 204. As exemplified in FIG. 1, printing data G indicating an image being formed on a medium 12 is supplied from an external device (not illustrated) such as a host computer or the like to the control unit 20. The control unit 20 controls each component of the liquid discharging apparatus 10 so that the image designated in the printing data G is formed on the medium 12.

The transportation mechanism 22 includes, for example, a transportation motor for transporting the medium 12 and a driving circuit driving the transportation motor (not illustrated), and transports the medium 12 in a Y direction based on control of the control unit 20. The liquid discharging portion 26 discharges ink, which is supplied from the liquid container 30, to the medium 12 based on control of the control unit 20. The liquid discharging portion 26 of the first embodiment is a serial head mounted on a box-shaped carriage 24. The liquid discharging portion 26 discharges the ink to the medium 12 in parallel with transportation of the medium 12 by the transportation mechanism 22 and reciprocation of the carriage 24, and thus a desired image is formed on a surface of the medium 12. Also, the liquid container 30 of a cartridge type having a small capacity can be mounted on the carriage 24 with the liquid discharging portion 26.

Figure 2:
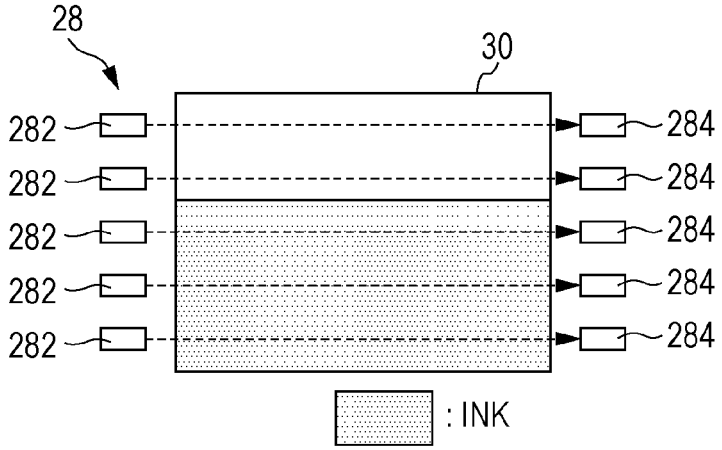
FIG. 2 is a diagram of a sensor which measures a remaining amount of ink inside a liquid container.
Figure 3:
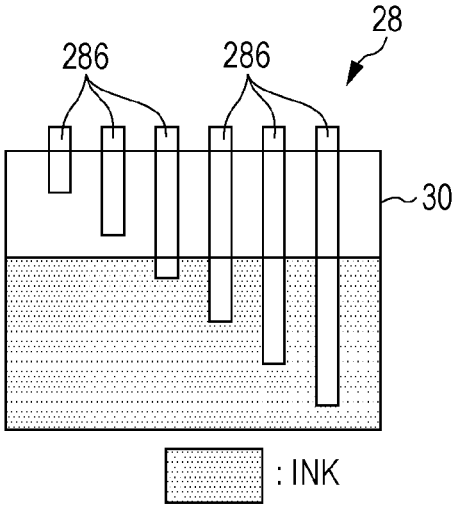
FIG. 3 is a diagram of another example of the sensor.

The sensor 28 is measurement equipment for measuring an amount A of ink stored inside the liquid container 30 (hereinafter, referred to as "remaining amount"). For example, as exemplified in FIG. 2, an optical detector, in which pairs of a light emitting element 282 such as a light emitting diode and a light receiving element 284 receiving light emitted from the light emitting element 282 are disposed at a different position from each other in a vertical direction, is appropriately used as the sensor 28. In a configuration of FIG. 2, in accordance with an amount of light received by each of the light receiving elements 284 via the liquid container 30, the position of a liquid surface of the ink in the liquid container 30 is measured as the remaining amount A. In addition, as exemplified in FIG. 3, a plurality of detection electrodes 286, positions of lower end portions in the vertical direction of which have different sizes from each other are disposed inside the liquid container 30, and electric measurement equipment, which measures the position of a liquid surface of the ink as the remaining amount A in response to a potential difference between the detection electrodes 286, may also be used as the sensor 28. A weight scale, which measures a weight of the liquid container 30 as the remaining amount A, is also used as the sensor 28.

Figure 4:
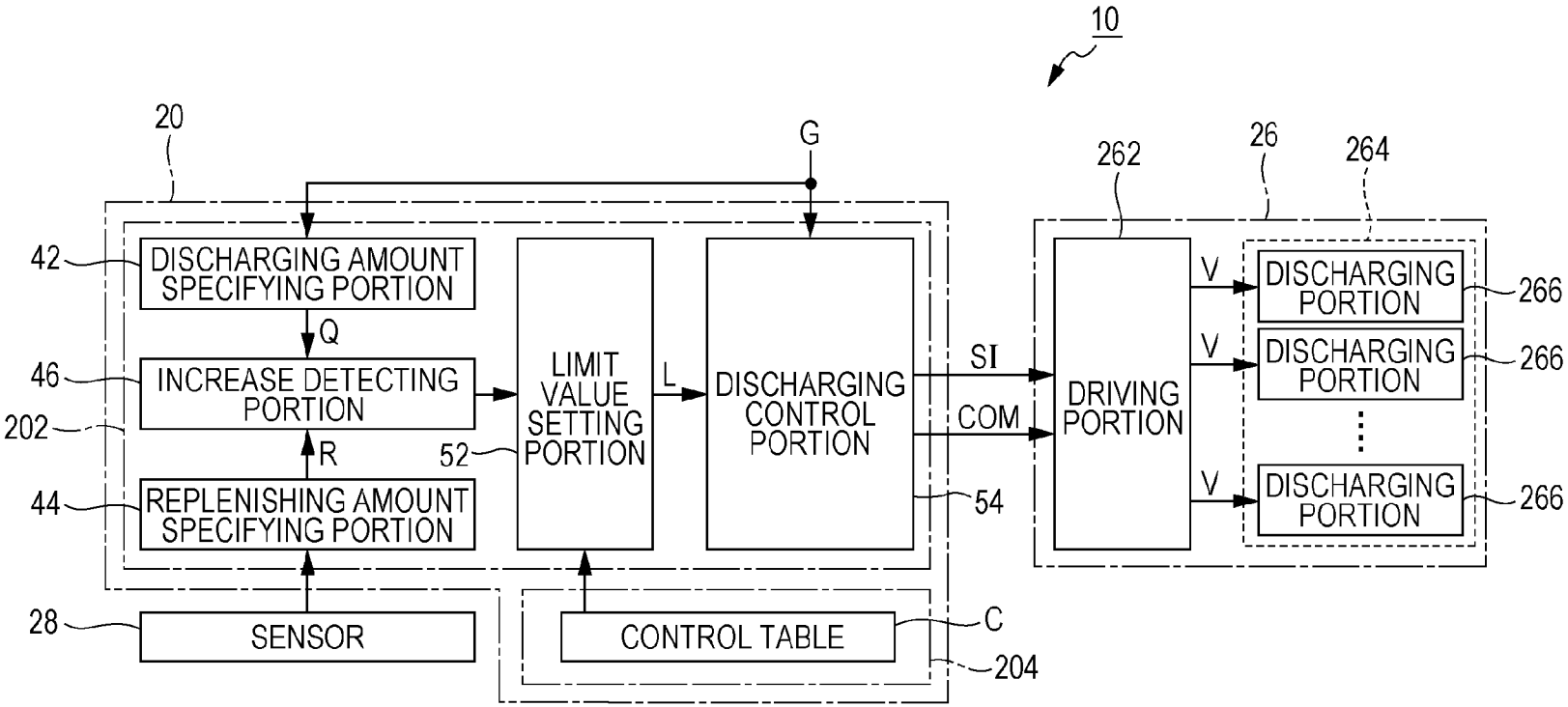
FIG. 4 is a functional configuration diagram of the liquid discharging apparatus.

FIG. 4 is a functional configuration diagram of the liquid discharging apparatus 10. In FIG. 4, for the sake of convenience, description of the transportation mechanism 22, the carriage 24, and the like are omitted. As exemplified in FIG. 4, the control unit 20 of the first embodiment generates a driving waveform signal COM and the printing signal SI and supplies the signals to the liquid discharging portion 26. The driving waveform signal COM is a voltage signal including a discharging pulse for discharging ink from a nozzle of the liquid discharging portion 26 in a predetermined cycle. Also, a configuration in which a plurality of the discharging pulses are included in one cycle of the driving waveform signal COM, or a configuration in which the plurality of driving waveform signals COM having different waveforms are used, can also be adopted. Meanwhile, the printing signal SI is a signal for instructing each nozzle of the liquid discharging portion 26 whether or not ink is discharged, and is generated in response to the printing data G supplied from the external device.

As exemplified in FIG. 4, the liquid discharging portion 26 of the first embodiment is provided with a driving portion 262 and a liquid discharging head 264. The driving portion 262 drives the liquid discharging head 264 based on the control of the control unit 20. The liquid discharging head 264 discharges ink, which is supplied from the liquid container 30, from a plurality of nozzles to the medium 12. The liquid discharging head 264 of the first embodiment is provided with the discharging portions 266 which correspond to different nozzles.

The driving portion 262 generates a driving signal V in response to the driving waveform signal COM and the printing signal SI supplied from the control unit 20 for each discharging portion 266, and outputs the signal to a plurality of the discharging portions 266 in parallel. Specifically, the driving portion 262 supplies a discharging pulse of the driving waveform signal COM as the driving signal V to the discharging portion 266, which is instructed by the printing signal SI of the plurality of discharging portions 266 about discharging ink, and supplies the driving signal V of a predetermined reference voltage to the discharging portion 266, which is instructed by the printing signal SI of the plurality of discharging portions 266 about non-discharging ink. Each of the discharging portions 266 discharges ink in response to the driving signal V supplied from the driving portion 262. Moreover, in a configuration in which a plurality of the driving waveform signals COM are used, or in a configuration in which the driving waveform signal COM includes a plurality of discharging pulses, a combination of the discharging pulses instructed by the printing signal SI is output to the discharging portions 266 as the driving signal V, and thus the discharging portions 266 are capable of controlling a change of a discharging amount of the ink.

Figure 5:
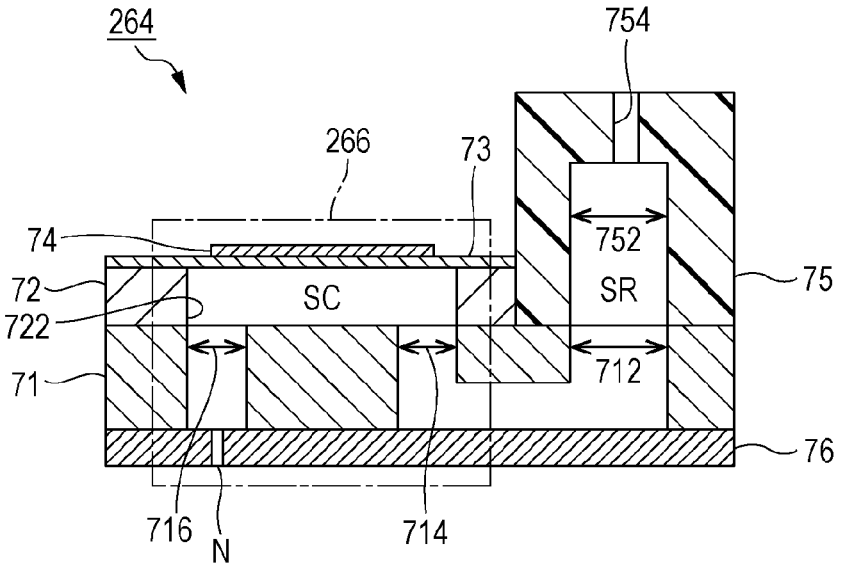
FIG. 5 is a sectional view of a liquid discharging portion.

FIG. 5 is a sectional view of the liquid discharging head 264 while focusing on one arbitrary discharging portion 266. As exemplified in FIG. 5, the liquid discharging head 264 is a structure in which a pressure chamber substrate 72, a vibration plate 73, a piezoelectric element 74, and a supporting member 75 are disposed on one side of a flow passage substrate 71, and a nozzle plate 76 is disposed on the other side thereof. The flow passage substrate 71, the pressure chamber substrate 72, and the nozzle plate 76 are, for example, formed of a flat plate material of silicon, and the supporting member 75 is, for example, formed by injection molding of a resin material. A plurality of nozzles N are formed on the nozzle plate 76. Moreover, the plurality of nozzles N can be arranged in multiple (for example, zigzag arrangement or stagger arrangement).

In the flow passage substrate 71, an opening portion 712, a branched flow passage (throttling flow passage) 714, and a communication flow passage 716 are formed. The branched flow passage 714 and the communication flow passage 716 are a through hole, which is formed in every nozzle N, and the opening portion 712 is an opening connected over the plurality of nozzles N. A space, where an accommodation portion (concave portion) 752 and the opening portion 712 of the flow passage substrate 71 are communicated with each other formed on the supporting member 75, functions as a common liquid chamber (reservoir) SR which stores ink supplied from the liquid container 30 through an introduction flow passage 754 of the supporting member 75.

The opening portion 722 is formed in every nozzle N in the pressure chamber substrate 72. The vibration plate 73 is a flat plate material capable of being elastically deformed, which is disposed on a surface opposite to the flow passage substrate 71 in the pressure chamber substrate 72. A space pinched between the vibration plate 73 and the flow passage substrate 71 inside of each opening portion 722 of the pressure chamber substrate 72, functions as a pressure chamber (cavity) SC which is replenished with ink supplied from the common liquid chamber SR through the branched flow passage 714. Each of the pressure chambers SC is communicated with the nozzle N through the communication flow passage 716 of the flow passage substrate 71.

The piezoelectric element 74 is formed in each nozzle N on a surface opposite to the pressure chamber substrate 72 in the vibration plate 73. Each of the piezoelectric elements 74 is a driving element in which a piezoelectric member is interposed between electrodes facing each other. When the piezoelectric element 74 is deformed by supplying of the driving signal V (discharging pulse), if the vibration plate 73 is vibrated, pressure inside the pressure chamber SC is changed, and the ink inside the pressure chamber SC is discharged from the nozzle N. One discharging portions 266 exemplified in FIG. 4 is a part including the piezoelectric element 74, the vibration plate 73, the pressure chamber SC, and the nozzle N.

As exemplified in FIG. 4, the control unit 20 of the first embodiment (controller 202) functions as a plurality of components (discharging amount specifying portion 42, replenishing amount specifying portion 44, increase detecting portion 46, limit value setting portion 52, and discharging control portion 54) for controlling discharging of ink by the liquid discharging portion 26, when the controller 202 executes a control program. Moreover, a function of a part of the control unit 20 can be provided on the liquid discharging portion 26.

The discharging amount specifying portion 42 specifies a discharging amount Q of the ink by the liquid discharging portion 26. The discharging amount specifying portion 42 of the first embodiment specifies a total weight of the accumulated ink discharged by the liquid discharging portion 26, after a time (hereinafter, referred to as replenishing time) when the liquid container 30 is replenished with the ink, as the discharging amount Q. Specifically, the discharging amount specifying portion 42 calculates the discharging amount Q by summing up the discharging amount of ink determined in every discharging portion 266 in response to the printing data G supplied from the external device after the replenishing time. The discharging amount Q calculated by the discharging amount specifying portion 42 is stored in the storage 204. Also, when the discharging amount designated by the printing signal SI in the discharging portions 266 after the replenishing time is summed up with the discharging portions 266 of the entirety of the liquid discharging portion 26, the discharging amount specifying portion 42 can also calculate the discharging amount Q.

The replenishing amount specifying portion 44 specifies a replenishing amount R of the ink to the liquid container 30. Specifically, the replenishing amount specifying portion 44 calculates a difference (that is, an increased amount of the ink when replenishing at the replenishing time) between the remaining amount A which is measured by the sensor 28 immediately after the replenishing time, and the remaining amount A which is measured by the sensor 28 immediately before the replenishing time as the replenishing amount R. In an initial state in which the ink of the liquid container 30 is not consumed, the remaining amount A in the state is specified as the replenishing amount R.

The replenishing amount specifying portion 44 specifies the remaining amount A in the liquid container 30 which is measured by the sensor 28 immediately before the turn-off of the power of the liquid discharging apparatus 10, and a current remaining amount A' in the liquid container 30. The replenishing amount specifying portion 44 can store and read the remaining amount A and the current remaining amount A' in and from the storage 204.

The increase detecting portion 46 detects an increase of the ink inside the liquid container 30. The increase detecting portion 46 of the first embodiment detects replenishing of the ink to the liquid container 30 by comparing the discharging amount Q specified by the discharging amount specifying portion 42 with the replenishing amount R specified by the replenishing amount specifying portion 44. Specifically, in a case where the discharging amount Q is much more than the replenishing amount R replenished at a previous time, there is a high possibility that the liquid container 30 is replenished with the ink from replenishing at the previous time to a current time. Therefore, schematically, the increase detecting portion 46 of the first embodiment determines that the liquid container 30 is replenished with the ink in a case where the discharging amount Q exceeds the replenishing amount R (Q>R), and determines that the liquid container 30 is not replenished with the ink in a case where the discharging amount Q is lower than the replenishing amount R (Q<R). A time when the increase detecting portion 46 determines that the liquid container 30 is replenished with the ink is confirmed as the replenishing time.

The increase detecting portion 46 of the first embodiment detects replenishing of the ink to the liquid container 30 by comparing the remaining amount A with the current remaining amount A' specified by the replenishing amount specifying portion 44. Specifically, in a case where the remaining amount A in the liquid container 30 which is measured immediately before the previous turn-off of the power of the liquid discharging apparatus 10 is much more than current remaining amount A' in the liquid container 30, there is a high possibility that the liquid container 30 is replenished with the ink from the previous turn-off of the power to a current time. Therefore, schematically, the increase detecting portion 46 of the first embodiment determines that the liquid container 30 is replenished with the ink in a case where the current remaining amount A' in the liquid container 30 exceeds the remaining amount A in the liquid container 30 which is measured when previously turning-off the power (A'>A), and determines that determining whether the liquid container 30 is replenished with the ink or not is further needed in a case where the current remaining amount A' in the liquid container 30 is equal to or lower than the remaining amount A in the liquid container 30 which is measured when previously turning-off the power (A'≤A).

The limit value setting portion 52 sets a limit value L of a duty relating to discharging of the ink by the liquid discharging portion 26. A duty (printing duty) of the liquid discharging portion 26 indicates a total amount (a total amount of the ink discharged from each nozzle of the liquid discharging portion 26) of the ink discharged by the liquid discharging portion 26 within a predetermined unit time, and is changed in accordance with contents of an image designated in the printing data G. The limit value L is an upper limit value of the duty.

The ink in a flow passage, which reaches the nozzle N from the liquid container 30 through the common liquid chamber SR and the pressure chamber SC (hereinafter, referred to as "supplying flow passage"), is thickened due to evaporation of moisture through a wall surface of the flow passage, or the like. Particularly, in the liquid discharging apparatus 10 of a CISS method, the viscosity of the ink inside the supplying flow passage is likely to increase because a large amount of ink stored in the liquid container 30 is accumulated inside the supplying flow passage for a long time, when compared to a configuration in which the liquid container 30 of a cartridge type having a small capacity is used. If a pressure loss inside the supplying flow passage is significant due to thickening of the ink, it is difficult to discharge ink of a duty in accordance with the contents of the printing data G. In consideration of the above described circumstance, the limit value setting portion 52 of the first embodiment changes the limit value L with time so as to cooperate with a degree of thickness of the ink inside the supplying flow passage.

The discharging control portion 54 controls discharging of the ink by the liquid discharging portion 26 by supplying the driving waveform signal COM and the printing signal SI described above to the liquid discharging portion 26. The discharging control portion 54 of the first embodiment controls the liquid discharging portion 26 so that the ink is discharged with a duty within a range of the limit value L set by the limit value setting portion 52. Specifically, if a duty (hereinafter, referred to as "target duty") calculated from the printing data G exceeds the limit value L, the discharging control portion 54 causes the liquid discharging portion 26 to discharge ink with a duty lower than the limit value L by generating the printing signal SI so as to reduce a total number or ratio of the nozzles N discharging the ink. Meanwhile, if the target duty is lower than the limit value L, the discharging control portion 54 generates the printing signal SI so that the liquid discharging portion 26 discharges the ink based on the target duty calculated from the printing data G. As a result of control by the discharging control portion 54 described above, a duty of discharging by the liquid discharging portion 26 is limited to be in a range lower than the limit value L.

Figure 6:
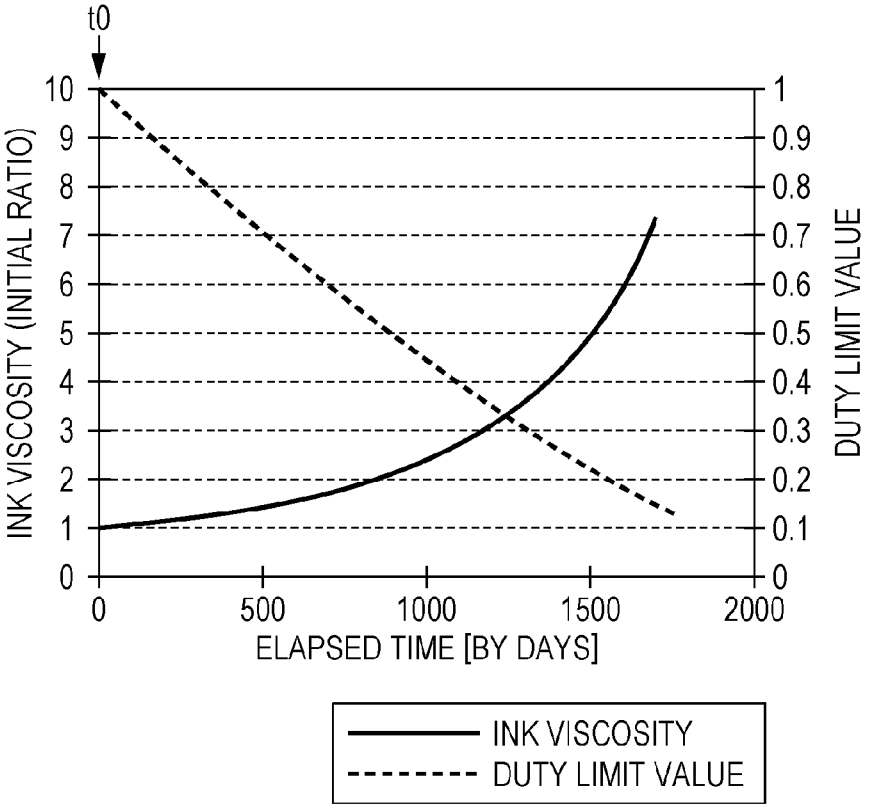
FIG. 6 is a graph of a change over time of ink viscosity and a duty limit value.

FIG. 6 illustrates a change of viscosity of the ink with time inside the supplying flow passage. As illustrated by a solid line in FIG. 6, since the viscosity of the ink inside the supplying flow passage increases with time from a time t0 (replenishing time) when the liquid container 30 is replenished with the ink, discharging of the ink with a high duty by the liquid discharging portion 26 gradually becomes difficult. In consideration of a tendency described above, the limit value setting portion 52 of the first embodiment sets the limit value L of the duty in accordance with an elapsed time T from the time replenishing the liquid container 30 with the ink. Specifically, as illustrated by a broken line in FIG. 6, the limit value L of the duty is reduced with an increase of the elapsed time T (that is, with time) so as to be cooperate with an increase in the viscosity of the ink with time.

Figures 7, 8:
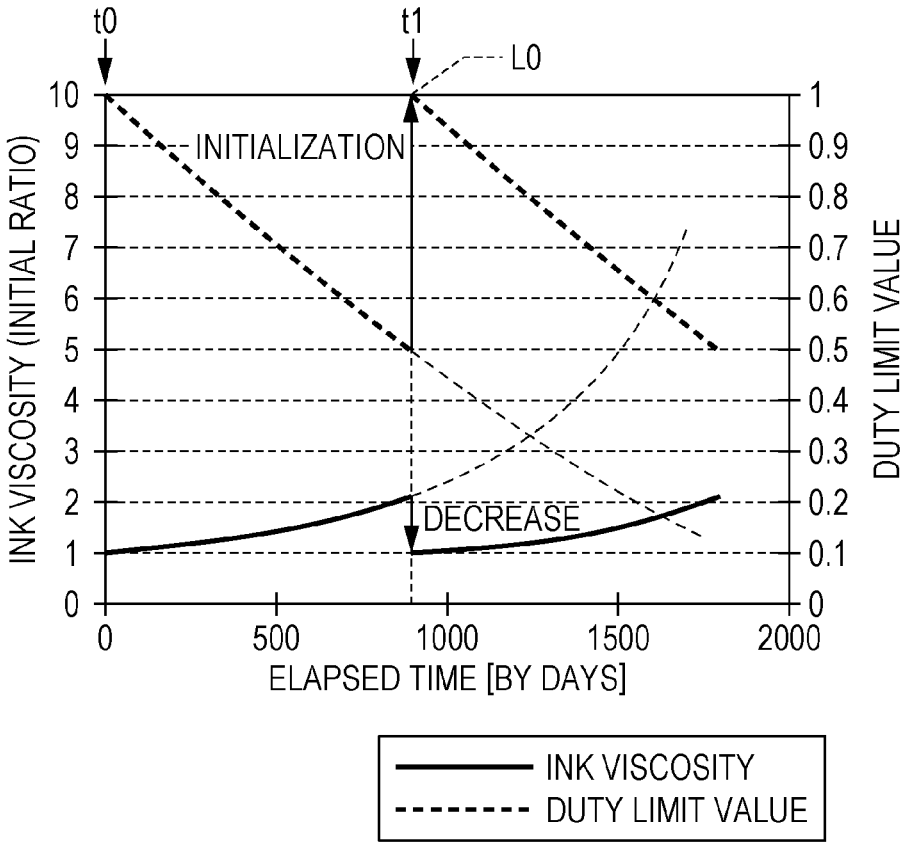
FIG. 7 is a schematic diagram of a control table.
FIG. 8 is a graph of a change over time of ink viscosity and a duty limit value.

Specifically, a control table C illustrated in FIG. 7 stored in the storage 204 is used for setting the limit value L by the limit value setting portion 52. The control table C is a data table which allows each numerical value (T1, T2, and the like) of the elapsed time T from the replenishing time and each numerical value (L1, L2, and the like) of the limit value L to correspond to each other. As described with reference to FIG. 6, each numerical value of the control table C is set in advance so that as the elapsed time T from the replenishing time is increased, the limit value L is reduced. Specifically, based on the viscosity of the ink assumed with a relationship between the viscosity and the elapsed time T, each numerical value of the limit value L is experimentally or statistically selected so as to obtain a duty which can be realized by the liquid discharging portion 26.

In the meantime, as ink with which the liquid container 30 is replenished, there is an assumption that ink having low viscosity is used in which thickening of the ink due to evaporation of moisture has not occurred, and therefore, as exemplified in FIG. 8, if the liquid container 30 is replenished with the ink at the time t1, the viscosity of the ink which is increased with time until immediately before replenishing is discontinuously lowered. That is, the liquid discharging portion 26 is capable of discharging the ink with a high duty by replenishing the ink in the liquid container 30. In consideration of a tendency described above, as exemplified in FIG. 8, the limit value setting portion 52 of the first embodiment initializes the limit value L in a case (replenishing time) in which the increase detecting portion 46 detects replenishing of the ink to the liquid container 30. A numerical value L0 (hereinafter, referred to as "updated value") of the limit value L after being initialized is, for example, a maximum value of the limit value L (that is, a total amount of the ink which can be discharged from the liquid discharging portion 26 within a unit time).

Figure 9:
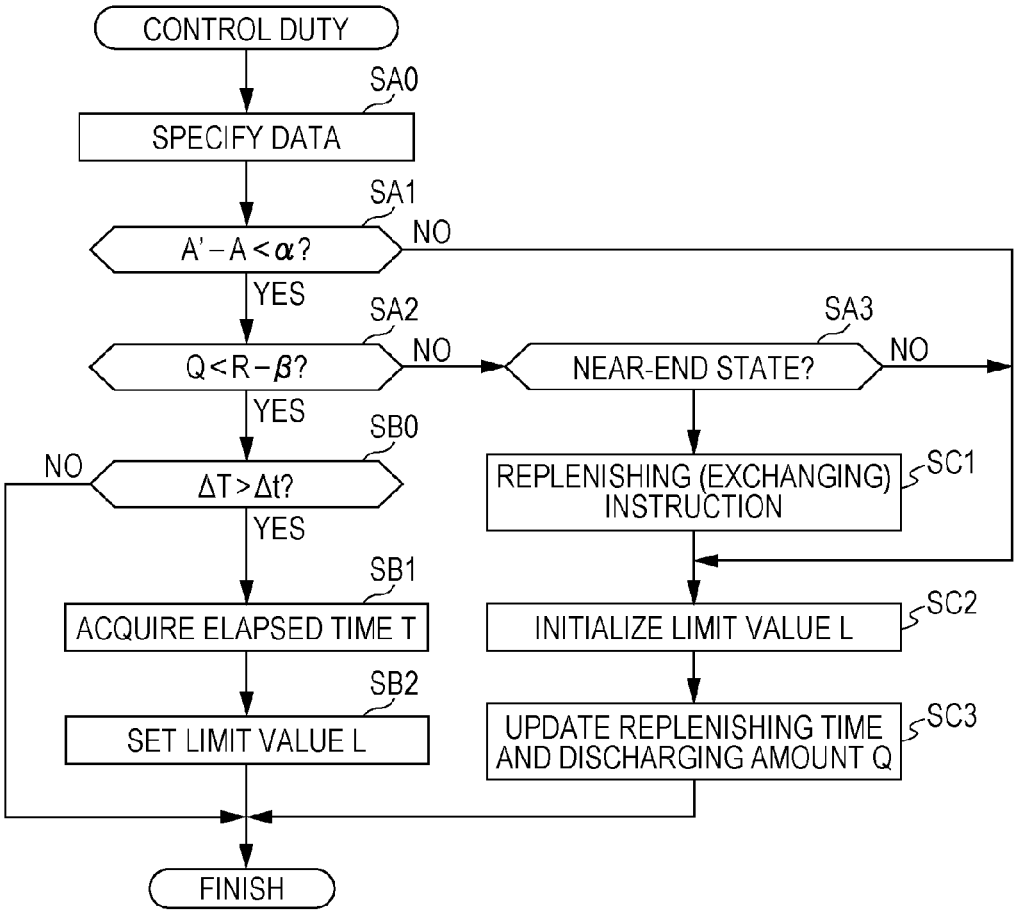
FIG. 9 is a flow chart of duty control.

FIG. 9 is a flow chart of a process (hereinafter, referred to as "duty controlling") for controlling the duty of the liquid discharging portion 26 by the control unit 20. For example, duty controlling described in FIG. 9 is started in a case where a user instructs the liquid discharging apparatus 10 of a printing operation, or immediately after power of the liquid discharging apparatus 10 is turned on.

If the duty controlling is started, in Step SA0, the limit value setting portion 52 specifies an elapsed time ΔT from when the previous printing operation is finished, the discharging amount specifying portion 42 specifies a discharging amount Q of the ink accumulated after the replenishing time, and the replenishing amount specifying portion 44 specifies the current remaining amount A' in the liquid container 30. For example, the limit value setting portion 52 calculates a length of time, from the time of finish of the previous printing operation, stored in the storage 204 to a current time measured by a clocking time (not illustrated), as the elapsed time TΔ. In addition, the discharging amount specifying portion 42 reads, for example, the discharging amount Q stored in the storage 204. In addition, the replenishing amount specifying portion 44 specifies the current remaining amount A in the liquid container 30 which is measured by the sensor 28, as the remaining amount A'.

Next, the increase detecting portion 46 determines whether a change amount of the current remaining amount A' of the ink with respect to the remaining amount A of the ink which is measured when previously turning-off the power and specified by the replenishing amount specifying portion 44 is less than the predetermined value α ($A'-A<\alpha$) (SA1). The predetermined value α is a positive number which is set in advance. For example, the positive number which shows the amount of the ink corresponding to 50% of the capacity of the liquid container 30 is set as the predetermined value α, and it is possible to determine whether the replenishing of the ink is performed or not when an amount of the ink, before the replenishing, is reached to an amount of which the viscosity of the ink is reduced.

In a case where a change amount of the ink in the current remaining amount A' with respect to the remaining amount A which is measured when previously turning-off the power exceeds the predetermined value α (SA1: NO), it is estimated that the liquid container 30 is replenished with the ink after the previous turning-off of the power. Because an actual replenishing amount R is unclear, at least it is possible to assume that an increased amount (difference) of the ink, from the remaining amount A which is measured when previously turning-off the power to the current remaining amount A', is the replenishing amount R. Accordingly, in a case where the increase detecting portion 46 detects the replenishing of the ink, the replenishing amount specifying portion 44 stores the increased amount of the ink, from the remaining amount A which is measured when previously turning-off the power to the current remaining amount A', in the storage 204 as the replenishing amount R, and the process proceeds to Step SC2. In Step SC2, the limit value setting portion 52 rewrites the previous replenishing time stored in the storage 204 to a current time, and initializes the limit value L of the duty of the liquid discharging portion 26 as the updated value L0.

Meanwhile, in a case where a change amount of the ink in the remaining amount A' with respect to the remaining amount A is lower than the predetermined value α (SA1: YES), it is further needed to determine whether the liquid container 30 is replenished with the ink or not after previous turning-off of the power of the liquid discharging apparatus 10, so the process proceeds to Step SA2.

In Step SA2, the increase detecting portion 46 compares the discharging amount Q specified by the discharging amount specifying portion 42 and the replenishing amount R specified by the replenishing amount specifying portion 44 with each other, and determines whether the discharging amount Q is lower than the numerical value (R−β) in which the predetermined value β is subtracted from the replenishing amount R (SA2). The predetermined value β is a non-negative value (zero or positive number) which is set in advance. The predetermined value β is a margin value which is added with an error between an actual discharging amount and the discharging amount Q calculated by the discharging amount specifying portion 42, the error being caused by variations such as displacement, a dimension of the flow passage, and resistance of the flow passage of the discharging portions 266. In other words, a process of Step SA2 is a process of determining whether or not a difference (R−Q) between the replenishing amount R and the discharging amount Q exceeds the predetermined value β.

In a case where the numerical value (R−β), in which the predetermined value β is subtracted from the replenishing amount R, is lower than the discharging amount Q (SA2: YES), it is estimated that the liquid container 30 is not replenished with the ink after the previous replenishing time.

Next, the limit value setting portion 52 determines whether the elapsed time ΔT, from when the previous printing operation is finished, exceeds a predetermined value Δt (SB0). The predetermined value Δt can be set as a positive number corresponding a short period of time in which the viscosity of the ink changes only little to the extent that there is no need of updating the limit value L. In a case where the elapsed time ΔT, from when the previous printing operation is finished, is equal to or lower than the predetermined value Δt (SB0: NO), the duty controlling is finished without changing of the limit value L. In a case where there is no need to update the limit value L in Step SB0, Steps (SB1 and SB2) of updating the limit value L of the duty, can be omitted. Step SB0 also can be omitted.

In a case where the elapsed time ΔT, from when the previous printing operation is finished, exceeds the predetermined value Δt (SB0: YES), the limit value L needs to be updated. Therefore, the limit value setting portion 52 updates the limit value L of the duty in accordance with the elapsed time T from the replenishing time (SB1 and SB2). Specifically, first, the limit value setting portion 52 acquires the previous elapsed time T from the replenishing time. For example, the limit value setting portion 52 calculates a length of time, from the previous replenishing time stored in the storage 204 to a current time measured by a clocking time (not illustrated), as the elapsed time T. Then, the limit value setting portion 52 specifies the limit value L in accordance with the elapsed time T (SB2). Specifically, the limit value setting portion 52 specifies the limit value L corresponding to the numerical value of the elapsed time T from the control table C. As a result of the operation described above, the limit value L used for a control of the liquid discharging portion 26 by the discharging control portion 54 is updated as the limit value L specified in Step SB2 by the limit value setting portion 52. That is, in a state in which the discharging amount Q is lower than the numerical value (R−β), in which the predetermined value β is subtracted from the replenishing amount R (SA2: YES), the limit value L of the duty of the liquid discharging portion 26 is reduced with time so as to be cooperate with an increase in the viscosity of the ink inside the supplying flow passage. Therefore, the ink is discharged from the liquid discharging portion 26 to the medium 12 with a duty in accordance with a progress of thickening of the ink inside the supplying flow passage.

Meanwhile, in a case where the discharging amount Q exceeds the numerical value (R−β) in which the predetermined value β is subtracted from the replenishing amount R (SA2: NO), it is estimated that the liquid container 30 is replenished with the ink after the previous replenishing time. However, even in a state in which an amount of the ink remaining in the liquid container 30 is nearly zero or zero (hereinafter, referred to as "near-end state"), a result of determination of Step SA2 can be negative. Here, the increase detecting portion 46 determines whether or not the liquid container 30 is in the near-end state (SA3). Specifically, the increase detecting portion 46 determines whether or not the liquid container 30 is in the near-end state, in accordance with whether or not the current remaining amount A' in the liquid container 30 measured by the sensor 28 is lower than a predetermined threshold (for example, positive number near zero). The predetermined threshold can be set as a positive number which is equal to or higher than the predetermined value β corresponding to the error in the discharging amount Q. In a state in which the liquid container 30 is set in the near-end state (SA3: YES), that is, in a case where the remaining amount A' is lower than the threshold, the control unit 20 instructs the user of replenishing the liquid container 30 with the ink or exchanging of the liquid container 30 by displaying an image or reproducing sound (SC1).

If the user responds to the instruction and replenishes the liquid container 30 with the ink or exchanges the liquid container 30, the replenishing amount specifying portion 44 determines whether a difference, between a remaining amount A1 before the replenishing, that is immediately before the replenishing time, and a current remaining amount A2 after the replenishing (that is immediately after the replenishing time), in the liquid container 30, is equal to or higher than the predetermined threshold used in Step SA3. In a case where the difference between the remaining amount A1 before the replenishing, and the remaining amount A2 after the replenishing is equal to or higher than the predetermined threshold, the replenishing amount specifying portion 44 stores the difference between the remaining amount A1 before the replenishing, and the remaining amount A2 after the replenishing, in the storage 204 as the replenishing amount R, and the process proceeds to Step SC2. Meanwhile, in a case where in a case where the difference between the remaining amount A1 before the replenishing, and the remaining amount A2 after the replenishing is lower than the predetermined threshold, the replenishing amount specifying portion 44 instructs the user of the replenishing (exchanging) the liquid container 30 until the difference between the remaining amount A1 before the replenishing, which is acquired at first in Step SC1, and the remaining amount A2 after the replenishing, which is measured after the final replenishing (exchanging) becomes equal to or higher than the predetermined threshold. If the difference between the remaining amount A1 before the replenishing, which is acquired at first, and the remaining amount A2 after the replenishing, which is measured after the final replenishing (exchanging) becomes equal to or higher than the predetermined threshold, the replenishing amount specifying portion 44 stores the difference in the storage 204 as the replenishing amount R, and the process proceeds to Step SC2.

In a case where the discharging amount Q exceeds the numerical value (R−β), in which the predetermined value β is subtracted from the replenishing amount R (SA2: NO), that is, in a case where the liquid container 30 is not in the near-end state (SA3: NO), it is possible to determine that the liquid container 30 is replenished with the ink after the previous replenishing time (therefore, the viscosity of the ink inside the supplying flow passage is lowered). Because the actual replenishing amount R is unclear, at least it is possible to assume that the current remaining amount A' in the liquid container 30 is the replenishing amount R. Accordingly, in a case where the increase detecting portion 46 detects the replenishing of the ink, the replenishing amount specifying portion 44 stores the current remaining amount A' in the liquid container 30, in the storage 204 as the replenishing amount R.

As described above, in a case where the increase detecting portion 46 detects replenishing of the ink, the limit value setting portion 52 initializes the limit value L of the duty of the liquid discharging portion 26 as the updated value L0 (SC2). That is, the limit value L which is used for controlling of the liquid discharging portion 26 by the discharging control portion 54 is initialized as the updated value L0 (for example, maximum value). Therefore, the ink having low viscosity can be efficiently discharged to the medium 12. If initialization of the limit value L described above is complete, a current time is confirmed as the latest replenishing time so as to be stored in the storage 204, and the discharging amount Q is stored in the storage 204 as zero (SC3).

The replenishing amount specifying portion 44 stores the remaining amount A in the liquid container 30 which is measured by the sensor 28 immediately before the turn-off of the power of the liquid discharging apparatus 10, in the storage 204, as the remaining amount A of the ink which is measured when previously turning-off the power. In addition, the limit value setting portion 52 stores the time measured by the clocking time (not illustrated) when the printing operation of the liquid discharging apparatus 10 is finished, in the storage 204 as the time when the previous printing operation is finished.

As understood from the above description, in the first embodiment, since the limit value L of the duty of the liquid discharging portion 26 is changed with time, while waste of the medium 12 or the ink is suppressed as compared to a configuration disclosed in PTL 1 in which a duty is controlled after occurrence of a discharging failure, there is an advantage that an appropriate limit value L capable of suppressing a discharging failure such as non-discharging, which is caused by increase in the viscosity of the ink inside the supplying flow passage, can be set. For example, the ink can be discharged with high efficiency by setting the limit value L as a large numerical value so as to relax a limitation of a duty of the liquid discharging portion 26, in a state in which thickening of the ink is not progressed with a small elapsed time T. Meanwhile, a discharging failure such as non-discharging caused by thickening of the ink inside the supplying flow passage can be suppressed by setting the limit value L as a small numerical value so as to limit a duty of the liquid discharging portion 26, in a state in which thickening of the ink is progressed with a large elapsed time T.

In addition, in the first embodiment, since the limit value L is initialized in a case where replenishing of the ink to the liquid container 30 is detected, there is also an advantage that discharging of highly efficient ink corresponding to the viscosity of the ink lowered due to replenishing is realized.

Second Embodiment

A second embodiment of the present invention will be described. Also, components having the same action and function as those of the first embodiment in each embodiment exemplified hereinafter will be given the same number as the numbers used in the first embodiment, and detailed description thereof will be properly omitted.

The limit value setting portion 52 of the second embodiment sets the limit value L of the duty in accordance with the replenishing amount R specified by the replenishing amount specifying portion 44. A configuration or operation other than setting of the limit value L is the same as that of the first embodiment. Therefore, the same effect as that of the first embodiment is realized even in the second embodiment. Setting of the limit value L by the limit value setting portion 52 of the second embodiment will be described hereinafter.

As the replenishing amount R is increased in the replenishing time, there is a tendency that thickening of the ink inside the supplying flow passage is reduced (that is, the viscosity of the ink is lowered). In consideration of the tendency described above, in a case where the liquid container 30 is replenished with the ink (after the processes of SA1: NO, SA3: NO, and SC1), the limit value setting portion 52 of the second embodiment initializes the limit value L of the duty of the liquid discharging portion 26 as the updated value L0 in accordance with the replenishing amount R in Step SC2. Specifically, in Step SC2 in the second embodiment, as the replenishing amount R is increased (that is, as the viscosity of the ink inside the supplying flow passage is lowered), the limit value setting portion 52 sets the updated value L0 to be a large numerical value. The process proceeds to SC3 thereafter.

In addition, in a state in which the liquid container 30 is not replenished with the ink (SA2: YES), in Step SB2, the limit value setting portion 52 in the second embodiment sets the limit value L in accordance with the elapsed time T and the replenishing amount R, so that a change of the limit value L with time (relationship between elapsed time T and limit value L) is carried out in accordance with the replenishing amount R. For example, a plurality of the control tables C in which relationships between the elapsed time T and the limit value L are different are prepared according to a range of different numerical values of the replenishing amount R, and the limit value setting portion 52 specifies the limit value L in accordance with the elapsed time T from the previous replenishing time, with reference to the control table C corresponding to the numerical value of the replenishing amount R specified by the replenishing amount specifying portion 44. For example, in a case where there is an assumption of the tendency described above that thickening of the ink is reduced as the replenishing amount R is increased, the limit value setting portion 52 sets the limit value L in accordance with the elapsed time T and the replenishing amount R so that a change (for example, reduced amount in each unit time) of the limit value L with respect to the elapsed time T is suppressed as the replenishing amount R is increased. If the limit value L is set in Step SB2, the duty controlling is finished.

As described above, in the second embodiment, the replenishing amount R of the ink to the liquid container 30 is taken into consideration when setting the limit value L to be changed with time. Therefore, based on the tendency in which the viscosity of the ink inside the supplying flow passage depends on the replenishing amount R, there is an advantage that the appropriate limit value L in accordance with the viscosity after changing caused by replenishing can be set.

Third Embodiment

A third embodiment of the present invention will be described. The limit value setting portion 52 of the third embodiment sets the limit value L of the duty in accordance with the discharging amount Q specified by the discharging amount specifying portion 42. A configuration or operation other than setting of the limit value L is the same as that of the first embodiment. Therefore, the same effect as that of the first embodiment is realized even in the third embodiment. Setting of the limit value L by the limit value setting portion 52 of the third embodiment will be described hereinafter.

Even when the elapsed time T from the previous replenishing time is the same, as the discharging amount Q is increased by the liquid discharging portion 26, there is a tendency that increase in the viscosity of the ink inside the supplying flow passage is suppressed. In consideration of the tendency described above, in a case where the liquid container 30 is replenished with the ink (after the processes of SA1: NO, SA3: NO, and SC1), the limit value setting portion 52 of the third embodiment initializes the limit value L of the duty of the liquid discharging portion 26 as the updated value L0 in accordance with the discharging amount Q in Step SC2. Specifically, in Step SC2 in the third embodiment, the limit value setting portion 52 sets the updated value L0 to be a large numerical value, as the discharging amount Q is increased (that is, as the viscosity of the ink inside the supplying flow passage is low). The process proceeds to Step SC3 thereafter.

In addition, in a state in which the liquid container 30 is not replenished with the ink (SA2: YES), in Step SB2, the limit value setting portion 52 sets the limit value L in accordance with the elapsed time T and the discharging amount Q, so that a change of the limit value L with time is carried out in accordance with the discharging amount Q. Specifically, the control table C is prepared in each range of the numerical value of the discharging amount Q, the limit value setting portion 52 sets the limit value L in accordance with the elapsed time T by referring to the control table C corresponding to the numerical value of the discharging amount Q specified by the discharging amount specifying portion 42. For example, there is an assumption of the above described tendency that thickening of the ink is reduced as the discharging amount Q is increased, the limit value setting portion 52 sets the limit value L in accordance with the elapsed time T and the discharging amount Q so that a change of the limit value L with respect to the elapsed time T is suppressed as the discharging amount Q is increased. If the limit value L is set in Step SB2, the duty controlling is finished.

As described the above, in the third embodiment, the discharging amount Q of the ink by the previous liquid discharging portion 26 is taken into consideration when setting the limit value L to be changed with time. Therefore, based on a tendency in which the viscosity of the ink inside the supplying flow passage depends on the discharging amount Q, there is an advantage that an appropriate limit value L can be set in accordance with an actual viscosity of the ink.

Fourth Embodiment

A fourth embodiment of the present invention will be described. The limit value setting portion 52 of the fourth embodiment sets the limit value L of the duty in accordance with a time (hereinafter, referred to as "non-operation time") from the previous turn-off of the power of the liquid discharging apparatus 10 to the current turn-on of the power. A configuration or operation other than setting of the limit value L is the same as that of the first embodiment. Therefore, the same effect as that of the first embodiment is realized even in the fourth embodiment. Setting of the limit value L by the limit value setting portion 52 of the fourth embodiment will be described hereinafter.

Although the elapsed time T from the previous replenishing time is the same, as a non-operation time of the liquid discharging apparatus 10 immediately before is longer, there is a tendency of progressing thickening of the ink inside the supplying flow passage. In consideration of the tendency described above, the limit value setting portion 52 of the fourth embodiment further specifies the non-operation time of the liquid discharging apparatus 10 in Step SA0. For example, the limit value setting portion 52 specifies the length of time from the time of the previous turn-off of the power of the liquid discharging apparatus 10, stored in the storage 204 to the current time of turn-on of the power, stored in the storage 204, as the non-operation time. In a case where the liquid container 30 is replenished with the ink (after the processes of SA1: NO, SA3: NO, and SC1), the limit value L of the duty of the liquid discharging portion 26 is initialized as the updated value L0 in accordance with the non-operation time in Step SC2 in the fourth embodiment. Specifically, in Step SC2 in the fourth embodiment, as the non-operation time is shorter (that is, as the viscosity of the ink inside the supplying flow passage is lowered), the limit value setting portion 52 sets the updated value L0 as a large numerical value. The process proceeds to Step SC3 thereafter.

In addition, in a state in which the liquid container 30 is not replenished with the ink (SA2: YES), the limit value setting portion 52 of the fourth embodiment sets the limit value L in accordance with the elapsed time T and the non-operation time so that a change of the limit value L with time is carried out in accordance with the non-operation time in Step SB2. For example, in a case where there is an assumption of the above described tendency that thickening of the ink is reduced as the non-operation time shortens, in Step SB2 in the fourth embodiment, the limit value setting portion 52 sets the limit value L in accordance with the elapsed time T and the non-operation time, so as to suppress reducing of the limit value L with respect to the elapsed time T as the non-operation time shortens. If the limit value L is set in Step SB2, the duty controlling is finished.

The limit value setting portion 52 stores, for example, the time measured by the clocking time (not illustrated) immediately before turning-off the power of the liquid discharging apparatus 10, in the storage 204, as the time of the previous turn-off of the power, and stores the time measured by the clocking time (not illustrated) immediately after turning on the power of the liquid discharging apparatus 10, in the storage 204, as the time of current turn-on of the power.

As described the above, in the fourth embodiment, the non-operation time of the liquid discharging apparatus 10 is taken into consideration when setting the limit value L to be changed with time. Therefore, based on a tendency that the viscosity of the ink inside the supplying flow passage depends on the non-operation time, there is an advantage that an appropriate limit value L according to an actual viscosity of the ink can be set.

Fifth Embodiment

A fifth embodiment of the present invention will be described. The limit value setting portion 52 of the fifth embodiment sets the limit value L of the duty in accordance with a temperature (hereinafter, referred to as "environment temperature") of an environment provided in the liquid discharging apparatus 10. A configuration or operation other than setting of the limit value L is the same as that of the first embodiment. Therefore, the same effect as that of the first embodiment is realized even in the fifth embodiment. Setting of the limit value L by the limit value setting portion 52 of the fifth embodiment will be described hereinafter.

Figure 10:
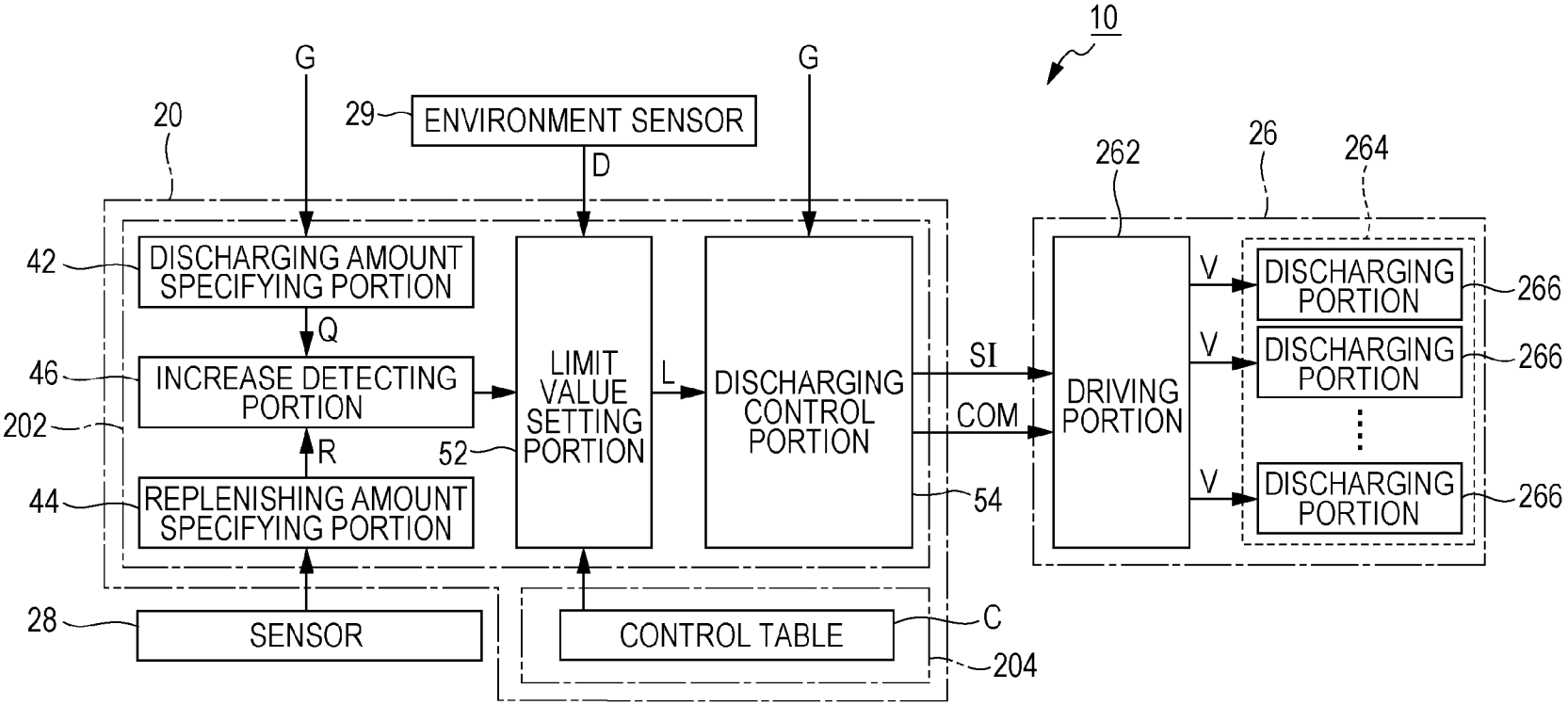
FIG. 10 is a functional configuration diagram of a liquid discharging apparatus in a fifth embodiment.

FIG. 10 is a configuration diagram of the liquid discharging apparatus 10 in the fifth embodiment. As exemplified in FIG. 10, in the liquid discharging apparatus 10 of the fifth embodiment, the environment sensor 29 is added to the same components as that of the first embodiment. Specifically, the environment sensor 29 is a temperature sensor which measures a temperature D of the liquid discharging apparatus 10. The temperature D measured by the environment sensor 29 is sequentially stored in the storage 204. In step SA0 in the fifth embodiment, the limit value setting portion 52 calculates an environment temperature from the temperature D measured by the environment sensor 29. For example, an average value between the temperature D before the previous turn-off of the power of liquid discharging apparatus 10 and the temperature D immediately after the power is turned on is calculated as an environment temperature. However, a configuration in which the temperature D measured by the environment sensor 29 is set as the environment temperature, or a configuration in which a representative value (for example, average value or medium value) of a plurality of the temperatures D sequentially measured by the environment sensor 29 is set as the environment temperature can be also adopted.

Although the elapsed time T from the previous replenishing time is the same, there is a tendency that thickening of the ink inside the supplying flow passage is progressed (that is, the viscosity of the ink is increased) as the environment temperature is increased. In consideration of the tendency described above, in a case where the liquid container 30 is replenished with the ink (after processes of SA1: NO, SA3: NO, and SC1), the limit value setting portion 52 of the fifth embodiment initializes the limit value L of the duty of the liquid discharging portion 26 as the updated value L0 in accordance with the environment temperature in Step SC2. Specifically, in Step SC2 in the fifth embodiment, the limit value setting portion 52 sets the updated value L0 as a small numerical value as the environment temperature is increased (that is, the viscosity of the ink inside the supplying flow passage is higher). The process proceeds to Step SC3 thereafter.

In addition, in a state in which the liquid container 30 is not replenished with the ink (SA2: YES), the limit value setting portion 52 sets the limit value L in accordance with the elapsed time T and the environment temperature so as to carry out a change of the limit value L with time in accordance with the environment temperature in Step SB2. For example, in a case where there is an assumption of the above described tendency that thickening of the ink is reduced as the environment temperature is lowered, in Step SB2 in the fifth embodiment, the limit value setting portion 52 sets the limit value L in accordance with the elapsed time T and the environment temperature so as to suppress the change of the limit value L with respect to the elapsed time T as the environment temperature is lowered.

As described above, in the fifth embodiment, the environment temperature of the liquid discharging apparatus 10 is taken into consideration when setting the limit value L to be changed with time. Therefore, based on the tendency that the viscosity of the ink inside the supplying flow passage depends on the environment temperature, there is an advantage that an appropriate limit value L in accordance with an actual the viscosity of the ink can be set.

Moreover, the environment temperature is exemplified for the sake of convenience in the above description; however, the limit value L of the duty in accordance with the humidity of an environment where the liquid discharging apparatus 10 is provided (hereinafter, referred to as "environment humidity") can be also set. The environment humidity is, for example, a representative value of humidity at various different times, or humidity at a certain time. If there is an assumption of the above described tendency that thickening of the ink is progressed as the environment humidity is lowered (lots of evaporation of moisture of ink), it is preferable that a configuration in which the updated value L0 is set as a small numerical value as the environment humidity is lowered, or a configuration in which a decrease of the limit value L with respect to the elapsed time T is suppressed as the environment humidity is higher.

In addition, the limit value setting portion 52 is also capable of setting the limit value L of the duty in accordance with both of the environment temperature and the environment humidity. As is understood from the above description, the limit value setting portion 52 of the fifth embodiment is comprehensively described as a component which sets the limit value L in accordance with at least one of the environment temperature and the environment humidity of the liquid discharging apparatus 10.

Modification Example

Each embodiment exemplified above can be variously modified. A specific modification aspect will be exemplified hereinafter. Two or more aspects selected from examples as follows can be combined appropriately within a range of not being inconsistent with each other.

(1) In each embodiment described above, one type of ink of the liquid container 30 is focused on for the sake of convenience; however, a process exemplified in each embodiment described above in each liquid container 30 (that is, in each type of ink) is executed, in a configuration in which a plurality of the liquid containers 30 stores different types ink. Specifically, regarding each of the plurality of liquid containers 30 (each of various types of ink), (a) a process in which the discharging amount specifying portion 42 specifies the discharging amount Q of the ink, (b) a process in which the replenishing amount specifying portion 44 specifies the replenishing amount R of the ink, (c) a process in which the increase detecting portion 46 detects an increase of the ink, (d) a process in which the limit value setting portion 52 sets the limit value L of the duty relating to the ink, and (e) a process in which the discharging control portion 54 controls the liquid discharging portion 26 to discharge the ink with a duty within a range of the limit value L set regarding the ink of the liquid container 30 are respectively executed.

(2) In each embodiment described above, the limit value L is set using the control table C, but a setting method of the limit value L by the limit value setting portion 52 is not limited to examples described above. For example, the limit value L can be also calculated by applying the elapsed time T to an arithmetic expression expressing a relationship between the elapsed time T and the limit value L. As from the second embodiment to the fifth embodiment, a setting method of the limit value L in accordance with variables (replenishing amount R, discharging amount Q, non-operation time, environment temperature, and environment humidity) other than the elapsed time T is also arbitrary. In addition, two or more variables arbitrarily selected from various types of variables (replenishing amount R, discharging amount Q, non-operation time, environment temperature, and environment humidity) exemplified from the second embodiment to the fifth embodiment can be reflected to the setting of the limit value L.

(3) In each embodiment described above, the configuration in which the liquid container 30 is replenished with the ink is exemplified, but a configuration in which existing the liquid container 30 can be exchanged into a new liquid container 30 replenished with the ink can be also adopted. The ink is increased by exchanging of the liquid container 30. Therefore, the increase detecting portion 46 according to each embodiment described above is inclusively described as a component for detecting the increase of the ink. The "increase of ink" detected by the increase detecting portion 46 includes both of an increase of the ink due to replenishing in a configuration in which the liquid container 30 can be replenished with the ink and an increase of the ink due to exchanging in a configuration in which the liquid container 30 can be exchanged.

(4) In each embodiment described above, the discharging amount Q of the ink by the liquid discharging portion 26 using the printing data G or the printing signal SI is estimated, but the setting method of the discharging amount Q by the discharging amount specifying portion 42 is not limited to the examples described above. For example, the discharging amount Q can be actually measured from the remaining amount A measured by the sensor 28. For example, a difference between the remaining amount A at the previous replenishing time and the current remaining amount A can be specified as the discharging amount Q. For example, a value obtained by accumulating a difference after the replenishing time can be specified as the discharging amount Q, the difference between the remaining amount A at the start time of the printing operation the remaining amount A at the finish time of the printing operation.

(5) In each embodiment described above, a case in which the limit value L is continuously changed is exemplified for the sake of convenience; however, the limit value L can be changed step by step as time elapses. For example, each numerical value of the elapsed time T1 and each numerical value of the limit value L are not required to correspond to each other one to one, for example, one numerical value of the limit value L can also correspond to a plurality of numerical values of the elapsed time T1. As is understood from the above description, even when the limit value L is constantly maintained within an interval of a part on a time axis, if the limit value L is changed with time within the other interval, a requirement such as "limit value L is changed with time" is satisfied.

(6) A component (driving element) which applies pressure to the inside of the pressure chamber SC is not limited to the piezoelectric element 74 exemplified in each embodiment described above. For example, a heating element which generates bubbles in the inside of the pressure chamber SC by heating and changes a pressure thereof can be used as a driving element. As is understood from the above examples, the driving element is inclusively described as a component (typically, a component for applying pressure to the inside of the pressure chamber SC) for discharging liquid, and an operation method (piezoelectric method or heating method) or a specific configuration is omitted.

(7) In each embodiment described above, the carriage 24 in which the liquid discharging portion 26 is mounted is exemplified as a serial head moving in an X direction; however, the present invention can be also be applied to a line head in which a plurality of the liquid discharging portions 26 are arranged in the X direction.

(8) The liquid discharging apparatus 10 exemplified by each embodiment described above can be applied to various equipment such as a facsimile or copy machine in addition to equipment used for printing. Also, a use application of the liquid discharging apparatus of the present invention is not limited to printing. For example, the liquid discharging apparatus discharging a solution of a coloring material is used as a manufacturing apparatus of forming a color filter of a liquid crystal displaying apparatus. In addition, the liquid discharging apparatus discharging a solution of a conductive material is used as a manufacturing apparatus of forming a wiring or an electrode of a wire substrate.

REFERENCE SIGNS LIST

10: liquid discharging apparatus
12: medium
20: control unit
202: controller
204: storage
22: transportation mechanism
24: carriage
26: liquid discharging portion
262: driving portion
264: liquid discharging head
266: discharging portion
28: sensor
29: environment sensor
30: liquid container
42: discharging amount specifying portion
44: replenishing amount specifying portion
46: increase detecting portion
52: limit value setting portion
54: discharging control portion
Q: discharging amount
R: replenishing amount
L: limit value

The invention claimed is:

1. A liquid discharging apparatus comprising:
a liquid discharging portion that discharges liquid supplied from a liquid container;
a limit value setting portion that sets a limit value to be changed with time; and
a discharging control portion that controls the liquid discharging portion to discharge liquid with a duty within a range of the limit value set by the limit value setting portion.

2. The liquid discharging apparatus according to claim 1, further comprising
an increase detecting portion that detects an increase of the liquid inside the liquid container,
wherein the limit value setting portion initializes the limit value in a case where the increase detecting portion detects the increase of the liquid.

3. The liquid discharging apparatus according to claim 1, further comprising
a replenishing amount specifying portion that specifies a replenishing amount of the liquid to the liquid container,
wherein the limit value setting portion sets the limit value in accordance with the replenishing amount specified by the replenishing amount specifying portion.

4. The liquid discharging apparatus according to claim 1, further comprising
a discharging amount specifying portion that specifies an amount of the liquid discharged by the liquid discharging portion,
wherein the limit value setting portion sets the limit value in accordance with the discharging amount specified by the discharging amount specifying portion.

5. The liquid discharging apparatus according to claim 1,
wherein the limit value setting portion sets the limit value in accordance with a non-operation time from a previous turn-off of power of the liquid discharging apparatus until a current turn-on of the power of the apparatus.

6. The liquid discharging apparatus according to claim 1,
wherein the liquid discharging portion discharges liquid supplied from a plurality of liquid containers which store various liquids different from each other,
wherein the limit value setting portion sets the limit value for each liquid container, and
wherein the discharging control portion controls the liquid discharging portion to discharge the liquid in the liquid container with a duty within a range of the limit value set relating to each liquid container.

* * * * *